US005225806A

United States Patent [19]

Stanley-Arslanok et al.

[11] Patent Number: 5,225,806

[45] Date of Patent: Jul. 6, 1993

[54] SECURITY SYSTEM HAVING MODE CONTROL OF SENSOR POINTS

[75] Inventors: Annette M. Stanley-Arslanok, Fountain Valley; Ronald B. Gregory, Garden Grove; Mark R. Walther, Laguna Hills; Chih-Shien S. Wung, Brea, all of Calif.

[73] Assignee: Honeywell Inc., Minneapolis, Minn.

[21] Appl. No.: 811,492

[22] Filed: Dec. 20, 1991

[51] Int. Cl.[5] ..... G08B 13/00

[52] U.S. Cl. ..... 340/541; 340/506; 340/518; 340/524

[58] Field of Search ..... 340/541, 518, 506, 525, 340/573, 531, 533, 524

[56] References Cited

U.S. PATENT DOCUMENTS 4,538,138 8/1985 Harvey et al. ..... 340/518 X

*Primary Examiner*—Jin F. Ng
*Assistant Examiner*—Thomas J. Mullen, Jr.
*Attorney, Agent, or Firm*—Robert B. Leonard

[57] ABSTRACT

A security system in which sensors are included in one or more groups which are stored in the system. Groups of sensors are selectably actuable by a user entering mode information into the system so that only the selected group(s) will provide indication of an alarm condition when a sensor indicates an alarm event has occurred.

6 Claims, 2 Drawing Sheets

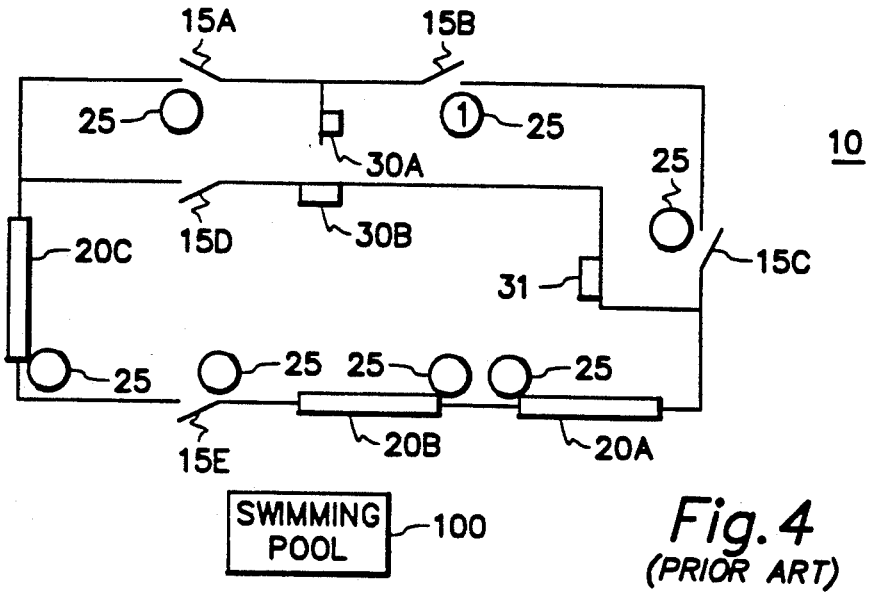
Fig. 4
(PRIOR ART)
| FIGURE I.D. NUMBER | NAME | POINT NO. | MODES | | | | | |
|---|---|---|---|---|---|---|---|---|
| | | | A | B | C | D | E | F |
| 20A | WINDOW 1 | 1 | X | | X | | | |
| 20B | WINDOW 2 | 2 | X | | X | | | |
| 20C | WINDOW 3 | 3 | X | | X | | | |
| 15A | DOOR 1 | 4 | X | X | | | X | |
| 15B | DOOR 2 | 5 | X | X | X | | X | |
| 15C | DOOR 3 | 6 | X | | X | | X | |
| 15D | DOOR 4 | 7 | X | | | X | X | |
X=ARMED
Fig. 5
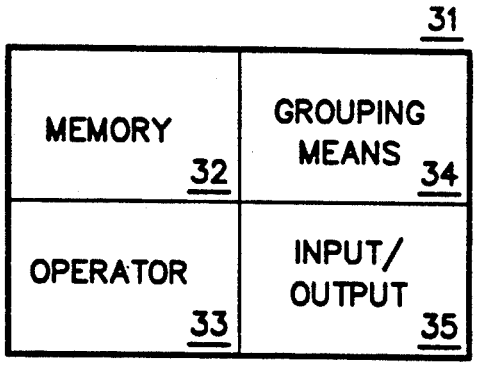
Fig. 6
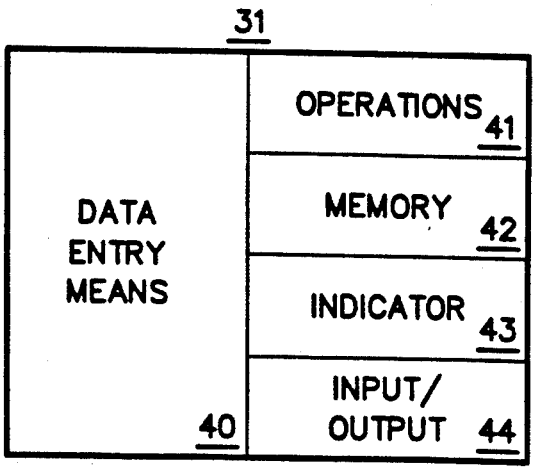
Fig. 7

SECURITY SYSTEM HAVING MODE CONTROL OF SENSOR POINTS

BACKGROUND OF THE INVENTION

This invention is directed to the field of home security systems, and more specifically relates to home security systems which monitor a number of access points into the home.

Home security systems generally monitor all access points, such as windows and doors, into a house. FIG. 1 shows a typical floor plan of a house 10 having a security alarm system of the prior art. The security alarm system included control panel 31, user panels 30A and 30B which were connected to the control panel and sensors 25 which were also connected to the control panel (connections not shown). One typical sensor 25 is shown in FIG. 3. A typical block diagram is shown in FIG. 4.

The floor plan indicates that house 10 has two primary spaces, rooms 11 and 12. In room 11, there are three doors 15A, B and C for entering and exiting the room. In room 12, there is door 15D and windows 20A, B and C. Rooms 11 and 12 are separated by door 15E.

The security system was set up so that one user panel was in each space and so that there was one sensor located at each door or window. The system was armed using the user panels. Typically, a sensor produced a first signal if the door or window was closed, and a second signal if the door or window was open. The control panel would receive these signals, and if the system were armed, would produce an alarm indication signal if the second signal was received.

In the past, a sensor was grouped with all sensors located within a single space. Note that in FIG. 1, sensors located in room 11 were assigned to group 1, while sensors located in room 12 were assigned to group 2. To arm the system, an operator would enter an arm command at one of the two user panels. Generally, both groups of sensors could be armed from either user panel.

Still, it was occasionally desirable to arm some points in a space, without arming others. It was also desirable to assign a point to more than one group for arming purposes. Lastly, it was desirable to have the system provide an indication when only a selected group of points was opened.

SUMMARY OF THE INVENTION

The present invention is a security control panel and security system which logically groups sensors at access points as defined by an operator, not by geographic location. The control panel includes an operator means which receives inputs from the sensors and initiates an indication means if one of the sensors indicates that one of the access control points is in an open state. The control panel includes a grouping means, which groups sensors according to instructions entered by an operator. Each point may be included in one or more groups.

When the inventive control panel is included in a security alarm system, further enhancements are possible. One such enhancement is that alarms can be armed for some points within a space, while leaving others unarmed. A further enhancement is that an indication will be given only when a point in the selected armed group is opened.

BRIEF DESCRIPTION OF THE DRAWING

FIG. 4 is a plan view of an typical house protected by the inventive security system.

FIG. 5 is a chart showing the logical grouping of points within the house of FIG. 4.

FIG. 6 is a block diagram of the inventive control panel 31.

FIG. 7 is a block diagram of a data entry panel of the inventive system.

DETAILED DESCRIPTION OF THE PREFERRED EMBODIMENT

Figure 1:
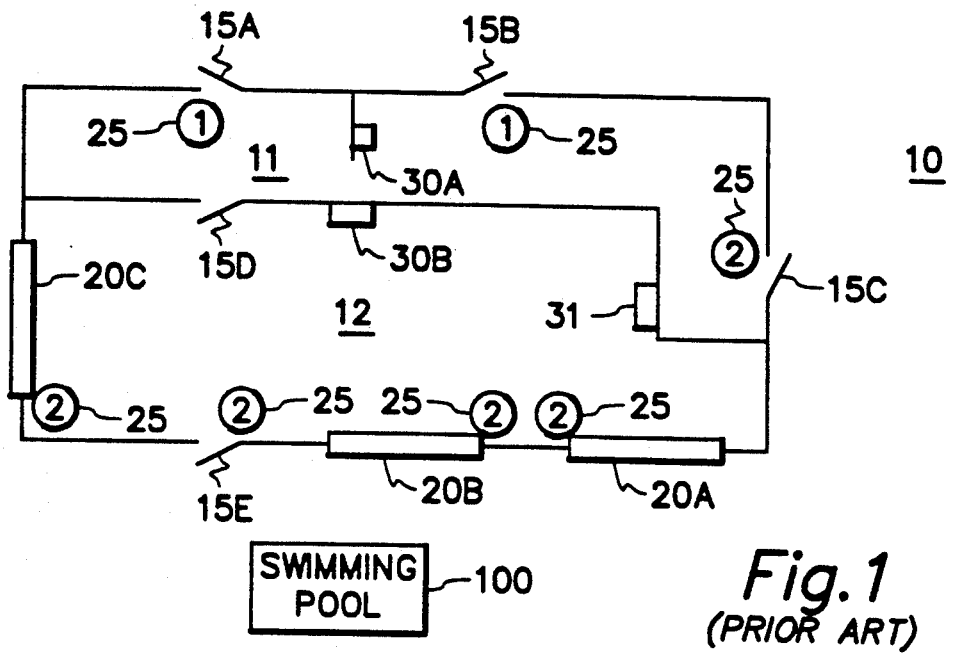
Fig. 1 (PRIOR ART)
FIG. 1 is a plan view of an typical house protected by a prior art security alarm system.
Figure 2:
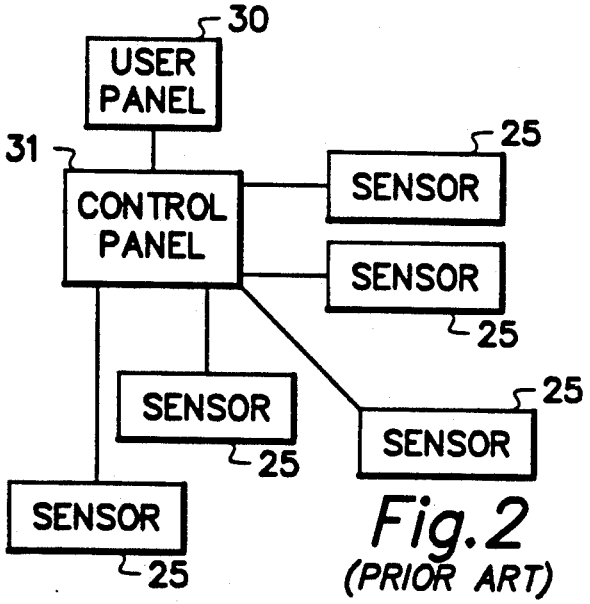
Fig. 2 (PRIOR ART)
FIG. 2 is a block diagram of a prior art security system.
Figure 3:
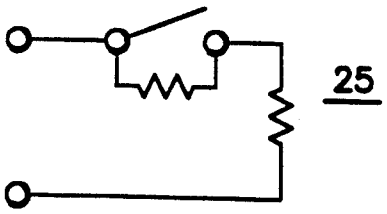
Fig. 3 (PRIOR ART)
FIG. 3 is a schematic diagram of an typical sensor of the prior art.

Referring now to FIG. 4, there shown is a typical house having the inventive security system and panel therein installed. Note that the house is identical to the house shown in FIG. 1, and that from this view the security system is similar. However, none of the sensors 25 are noted as belonging to a particular group. The basic functions of the alarm system are similar to that described with reference to FIG. 1.

FIG. 6 depicts the fundamental difference between the present invention and security systems of the prior art. FIG. 6 is a block diagram of the presently inventive control panel 31. The control panel includes memory 32, operations unit 33 grouping means 34 and input/output port 35.

Input/output port 35 is for translating the internal communications of the control panel into a form which can be understood by the user panels. The input/output port also translates the sensor signals and user panel signals into a form which can be used by the control panel.

Operations means 33 executes commands stored in memory 32 to control the operation of the security system. The operations means receives signals from the input/output port, operates on those signals based on the stored instructions, and then sends signals back through the input/output port for use by the rest of the system. As an example, if one sensor changed states by the closing of switch 303, a signal would be sent to the control panel to indicate the switch closure. The operations means would receive this information, and if the memory indicated that the particular sensor was in an armed state, the memory would tell the operations means to initiate an alarm indication signal.

Grouping means 34 is in fact memory specifically existing for the purpose of logical grouping of sensors. The physical memory device used may be an EEPROM. The user enters groups of points, each group being associated with a Mode identifier. Groups of sensors may be combined in the present system so that the entry of the predefined modes will cause the arming and disarming of selected sensors.

FIG. 5 shows one possible plan for the grouping of sensors in house 10. Mode A includes all sensors located within the house. It could arm all the points, for example, when the house is to be left vacant.

Mode B includes only Doors 1 and 2. It may be activated, for example, when the homeowner is not expecting any guests at the two armed doors, but wishes to be able to freely enter and exit the house and to leave windows open for fresh air.

Mode C shows all of the windows being armed along with Doors 2 and 3. This mode may be used where the swimming pool 100 is to be the center of some activity, and access through the house in a particular pattern is desired.

Conversely, mode D arms only Door 4. This could be used to prevent children from leaving the house to play in the pool area.

Mode E arms only the sensors associated with the four doors. This could be used for example at night when the house is occupied, but it is desirable to have the windows open for ventilation.

Lastly, Mode F is used for complete disarming of the system. This could be used when the house is occupied, access through any door is desirable and opening the windows is desirable.

FIG. 7 shows a user panel 30 of the present invention. User panel 30 includes data entry means 40, operational controller 41, memory 42, indicator 43 and input/output port 44.

Data entry means 40, which may be a keyboard, allows the user to enter data and instructions into the system. The operational controller 41 in cooperation with memory 42 control the operation of the user panel and directs communications with the control panel along with the input/output port. Indicator 43 provides the user with indication relating to the operation of the security system, and may provide audible and visual indication of an alarm condition. The indicator may include a liquid crystal display and a sound generator.

The foregoing has been a description of a novel and non-obvious security control panel and system. The inventors do not intend this description to limit the scope of the invention, but instead define the invention through the claims appended hereto.

We claim:

1. A security system central panel for control of a security system having at least two sensors located in a building which produce a signal indicative of the position of an access point, and the system allowing for operator modification of the system, comprising:

an operations means, said operations means receiving inputs from the sensors and producing an output in response to said inputs;

indication means for providing the operator an indication of said output;

memory connected to said operations means, said memory storing operations means instructions and operations means data; and grouping means connected to said memory and said operations means, said grouping means storing in said memory an operator defined group of the sensors, said grouping means further modifying said operations means instructions in response to said operator defined group.

2. The panel of claim 1, wherein:

said grouping means forms two groups of the sensors as selected by the operator, at least one sensor being in both groups.

3. A security alarm system for protection of a building having a plurality of access points, comprising:

a plurality of sensors, at least one of said plurality of sensors being located at each access control point to be monitored, said plurality of sensors each producing a signal indicative of the position of the access point;

a security system central panel connected to each of said plurality of sensors, comprising:

an operations means, said operations means receiving input from plurality of sensors and producing an output in response to said input;

memory connected to said operations means, said memory storing operations means instructions and operations means data;

grouping means connected to said memory and aid operations means, said grouping means storing in said memory an operator defined group of the sensors, said grouping means further modifying said operations means instructions in response to said operator defined group;

indication means for providing the operator an indication of said output; and data entry means for the operator to enter instructions into the system.

4. The system of claim 3, wherein:

said grouping means forms first and second groups of said plurality of sensors as selected by the operator, at least one sensor being in both groups.

5. The system of claim 4, wherein said sensors produce a first signal if their respective access point is open and a second signal otherwise.

6. The system of claim 5, wherein:

said indication means is active only when at least one of said plurality of sensors in said selected groups produces said first signal.

* * * * *

UNITED STATES PATENT AND TRADEMARK OFFICE

CERTIFICATE OF CORRECTION

PATENT NO. : 5,225,806

DATED : July 6, 1993

INVENTOR(S) : STANLEY-ARSLANOK ET AL.

It is certified that error appears in the above-indentified patent and that said Letters Patent is hereby corrected as shown below:

Column 4, line 24, insert --said-- between the words "from" and "plurality";

line 29, cancel "aid" and substitute --said--.

Signed and Sealed this

Third Day of May, 1994

Bruce Lehman

*Attest:*

BRUCE LEHMAN

*Attesting Officer*

*Commissioner of Patents and Trademarks*